US005413854A

United States Patent [19]

Sato

[11] Patent Number: 5,413,854

[45] Date of Patent: May 9, 1995

[54] OHP SHEET FOR THERMAL TRANSFER PRINTER

[75] Inventor: Kazuo Sato, Tokyo, Japan

[73] Assignee: Nisshinbo Industries, Inc., Tokyo, Japan

[21] Appl. No.: 268,121

[22] Filed: Jul. 6, 1994

[30] Foreign Application Priority Data

Jul. 15, 1993 [JP] Japan ..... 5-196750

[51] Int. Cl.[6] ..... B41M 5/00

[52] U.S. Cl. ..... 428/318.4; 428/195; 428/327; 428/500; 428/521; 428/913; 428/914

[58] Field of Search ..... 428/195, 318.4, 327, 428/500, 521, 913, 914

[56] References Cited

U.S. PATENT DOCUMENTS 5,169,468 12/1992 Royce et al. ..... 428/195

*Primary Examiner*—Pamela R. Schwartz

*Attorney, Agent, or Firm*—Rogers & Killeen

[57] ABSTRACT

An OHP sheet for a thermal transfer printer in which the ink receiving layer is a transparent, porous layer, having cushioning characteristics when the sheet is printed, and in which the layer becomes transparent by heat treatment after printing, the OHP sheet having an excellent capacity of the representation of dots in detailed portion and tone gradation.

The OHP of the present invention is made of a transparent plastic sheet having an ink receiving layer on at least one side thereof, the ink receiving layer being a porous layer which contains polymer particles in which the glass transition temperature is 30°–150° C. and the particle size is 0.05–2 μm, further the ink receiving layer being opaque under normal temperatures and becoming transparent when the layer is heated at 30°–150° C.

6 Claims, No Drawings

OHP SHEET FOR THERMAL TRANSFER PRINTER

BACKGROUND OF THE INVENTION

1. Field of the Invention

The present invention relates to an OHP (overhead projector) sheet which is used for printing images, letters or the like by means of a printer in which a ribbon containing hot-melt ink layer composed of coloring material and a binder such wax or the like is utilized, the binder in the ink layer being melted when heated by means of a thermal head or the like while the ink layer is in contact with a recording paper in order to transfer the ink layer to the recording paper.

2. Description of Related Art

Conventionally, a non-porous optical transmission type transparent sheet obtained by coating a transparent plastic film with a binder having a high affinity with the binder of a ribbon and further by performing surface treatment such as antistatic treatment, corona discharge treatment or the like has been utilized as an OHP sheet for a thermal transfer printer.

However, the aforementioned conventional OHP sheet has a low capacity for absorbing hot-melted ink when the OHP sheet is printed by means of a thermal transfer printer because the surface thereof is non-porous. Ordinarily, for full-color printing, ribbons of three colors including yellow, magenta and cyanogen are hit so that the respective colors overlap each other. At this time, ink previously adhered to a sheet is likely to be transferred back to the ribbon together with other ink applied thereafter, thereby lowering the reproducibility and tone representation of the dots in detailed portions.

Because the ink receiving layer is also non-porous and has little cushioning characteristics, when the layer is heated by means of a thermal head, the area in which the thermal head is in contact with the surface of the ink receiving layer decreases remarkably, so that, in a method of representation of density according to tone gradation depending on area size, the color development density of a printed material may be very low.

SUMMARY OF THE INVENTION

Accordingly, in view of the aforementioned conventional art, an object of the present invention is to provide an OHP sheet for a thermal transfer printer in which ink previously adhered to the sheet is not transferred back to a ribbon together with other ink applied thereafter so that the ink applied thereafter overlaps the previously applied ink in full-color printing by means of a thermal transfer printer and in which the cushioning characteristics of an ink receiving layer is excellent so as to ensure a large area in which a thermal head contacts the ink receiving layer, thereby obtaining a printed material having excellent color density using a method of representing color density according to the tone gradations of the relevant area.

To this end, there is provided an OHP sheet for a thermal transfer printer which is a transparent plastic sheet having an ink receiving layer on at least one side thereof, the ink receiving layer being a porous layer which contains polymer particles in which the glass transition temperature is 30°–150° C. and the particle size is 0.05–2 μm. Further, the ink receiving layer is opaque under normal temperatures and becomes transparent when the layer is heated to 30°–150° C.

As a result of accumulated research, the inventor of the present invention has noticed that the aforementioned problem can be solved by providing at least a single surface of a transparent plastic film with an ink receiving layer which is opaque and porous, has cushioning characteristics under normal temperatures, and which becomes transparent when the layer is heated to an appropriate temperature, and therefore has completed the present invention. The OHP for the thermal transfer printer according to the present invention is obtained by the following steps.

A transparent plastic film which is utilized as the base material according to the present invention is made of transparent thermoplastic resin film, polyvinyl alcohol film, cellulose derivative film or an oriented film of these materials.

As the transparent thermoplastic resin film, films of polyethylene terephthalate, polypropylene, polystyrene, polyvinyl chloride, polymethyl methacrylate, polyetyrene, polycarbonate or the like, films of these materials which are subjected to undercoating for enhancing adhesion between such a film and an ink receiving layer, and films of these material which are subjected to antistatic treatment or corona discharge treatment may be used. However, generally, polyethylene terephthalate, which is highly resistant to heat, is preferable.

Regarding the ink receiving layer which is opaque and porous, has cushioning characteristics under normal temperatures and which becomes transparent when the layer is heated, any binder may be used if it visually becomes transparent when it is made into a film. Generally, it is preferable to select a binder which has excellent affinity with the binder of the ribbon. As a typical example, vinyl chloride-acetate copolymer resin, polyester resin, acrylic resin or the like is available and these resins can be used independently or in a mixture with other materials. These resins can be adapted to an emulsion or water solution and coated on a base material.

The polymer particles which are contained in the ink receiving layer, the polymer particles being a feature of the present invention, are formed of styrene polymer, styrene-butadiene copolymer, styrene-acrylic copolymer or the like in which the diameter is 0.05–2 μm and the glass transition temperature is 30°–150° C. Such particles are dispersed in an emulsion or water solution of the aforementioned binder, and the emulsion or the water solution is then coated on a base material and dried in order to obtain an opaque ink receiving layer which is porous and has cushioning characteristics under normal temperatures. The weight ratio of the polymer particles relative to the binder is 100–500 weight parts relative to the 100 weight parts of the binder, and preferably, 200–400 weight parts. If the weight ratio thereof is below 100 weight parts, the capacity of the ink receiving layer to absorb hot-melted ink and the cushioning characteristics are low. If the weight ratio is 500 weight parts or more, the surface strength weakens and the ink receiving layer becomes likely to peel. Thus, the weight parts of 500 or more is not preferable.

However, the mechanism in which the ink receiving layer becomes transparent when heated according to the present invention is as follows. That is, light is refracted on an interface of air between polymer particles filled in the ink receiving layer under normal temperatures. As a result, the sheet according to the present invention looks white due to the dispersion of light, however, different polymers are fusion-bonded with each other, so that the interface of air between the polymer particles decreases, thereby hindering the dispersion of light. As a result, the sheet of the present invention becomes transparent.

Considering the storage characteristic and the ease of use of the sheet of the present invention, the temperature for making the sheet transparent is 30°–150° C., and preferably 50°–130° C., and more preferably 70°–130° C. The range of the temperature for making the sheet transparent can be obtained by adjusting the glass transition temperature of the polymer particles. The most desirable size of the polymer particles for making the sheet transparent by fusing the particles by heating is 0.05–2 μm. The glass transition temperature of the polymer particles is determined by the temperature for making the sheet transparent, specified in the sheet of the present invention, and is 30°–150° C. or, more preferably, 50°–130° C. If the glass transition temperature is below 30° C., polymer particles are filmed under normal temperatures so that the sheet becomes transparent under storage conditions before printing. A glass transition temperature of more than 150° C. is not preferable because there are problems in terms of the cost of energy used by the heating apparatus and safety of use.

As described before, a desirable temperature for making transparent the OHP sheet of the present invention is determined depending on how high the glass transition temperature of the polymer particles is set. Thus, it is necessary to keep the polymer particles from being made into film, that is, to keep the sheet opaque in order to maintain the cushioning characteristics until printing and therefore the sheet may be heated after printing instead.

Use of the OHP sheet of the present invention enables the following representation. If a sheet of the present invention is heated according to the pattern of an image by means of a thermal head directly, or through an adhesion/fusion preventive layer of hot-melt type ink ribbon or film, it is possible to change the degree of transparency depending on the degree of heating. Thus, it is possible to grade the transparency thereof. If this sheet is projected by means of an overhead projector, images having gradation of transparency can be displayed on the screen. In this case, if opaque portions appropriately are left on the sheet, it is possible to obtain an image in which only the printed portion is bright and the entire background is dark.

On the other hand, in order to make transparent the entire OHP sheet or a portion thereof desired to be stressed, it is permissible to heat such a portion by means of a thermal head directly, or through the portions of a hot-melt ink ribbon having no coloring material or by an adhesion/fusion preventive layer of a film or the like, or by means of a drier after the images are printed.

Further, in order to prevent a sheet from being curled due to the heat from a projector, it is an effective method to provide the back side of the OHP sheet with a curl preventive layer, or if a printer is equipped with a sheet entry detecting device, it is an effective method to provide the edge of the OHP sheet of the present invention with a coloring sensor mark, or more preferably, a light transparency coloring sensor mark.

Still further, in order to recognize the back or front side of the OHP sheet, it is permissible to trim the OHP sheet or process the entire sheet or part of the sheet so as to contain an adhesive layer and attach a mounting paper after printing and heating.

The OHP sheet of the present invention is an opaque sheet in which the ink receiving layer is porous, and which has cushioning characteristics under normal temperatures. After printing, the sheet is heated to make it transparent. As described above, because this sheet has excellent ink absorption capacity and cushioning characteristics against a thermal head in thermal transfer printing, printing characteristic, particularly, representation of dots in detailed portion or tone gradation, is very excellent.

Thus, according to the present invention, it has become possible to provide an OHP sheet capable of demonstrating its color characteristics fully in a thermal transfer printer having excellent full-color characteristics.

DESCRIPTION OF THE PREFERRED EMBODIMENTS

Embodiments of the present invention will be described below.

Whiteness degree in the present embodiment refers to the ratio of reflection against a standard magnesium oxide plate when the surface of an OHP sheet is irradiated with blue-violet spectral light using a Hunter whiteness degree testing device. Opaqueness refers to the ratio of reflection measured about an OHP sheet backed by a black standard plate with respect to the ratio of reflection measured about an OHP sheet backed by a white standard plate, the reflection ratios being measured using a Hunter whiteness degree testing device equipped with a green filter.

EXAMPLE 1

As polymer particle, 300 parts (weight part) of styrene-butadiene copolymer polymer latex (made by Asahi Kasei, solid matter: 45% glass transition temperature: 83° C., particle size: 0.2 μm) was mixed with 100 parts of vinyl chloride-acrylic resin copolymer resin emulsion (made by Nisshin Kagaku, Vinybran 270, solid matter: 40%) and the mixture was agitated completely to obtain coating solution.

This solution was coated on transparent polyester film having the thickness of 100 μm by means of a wire bar coater having the diameter of 0.5Φ and dried by hot air of 70° C. sent from a drier in order to obtain an OHP sheet which is an example of the present invention. The surface layer thereof was opaque, white, porous, having a cushioning characteristic. The surface thickness was 25 μm, the whiteness degree was 75% and the opaqueness was 80%.

The obtained OHP sheet was printed in full colors by means of a thermal transfer printer and dried for two minutes in a constant-temperature drier of 120° C. to make transparent the opaque surface layer. Consequently, the surface layer was made transparent and the OHP sheet in which the capacity of the representation of dots in detailed portion and tone gradation was excellent, could be obtained.

EXAMPLE 2

As polymer particle, 300 parts of styrene polymer latex (made by Asahi Kasei, solid matter: 47%, glass transition temperature: 107° C., particle size: 0.5 μm, molecular weight: 50,000) was mixed with 100 parts of vinyl chloride-acrylic copolymer resin emulsion used in Example 1 and the mixture was agitated completely to obtain coating solution.

This solution was coated and dried under the same coating condition as in Example 1 to obtain another type of OHP sheet of the present invention. The surface layer thereof was white, opaque, porous and had cushioning characteristics. The surface thickness was 22 μm, the whiteness degree was 70% and the opaqueness was 77%.

The obtained OHP sheet was printed in full colors by means of a thermal transfer printer and dried for two minutes in a constant-temperature drier of 130° C. Consequently, the surface layer was made transparent and the OHP sheet in which the capacity of representation of dots in detailed portion and tone gradation was excellent, could be obtained.

EXAMPLE 3

200 parts of styrene polymer particles used in Example 2 was mixed with vinyl chloride-vinyl acetate copolymer emulsion (made by Nisshin Kagaku, Vinybran 240, solid matter: 40%) and the mixture was agitated completely to obtain coating solution.

This solution was coated and dried under the same coating condition as in Example 1 to obtain still another type of OHP sheet of the present invention. The surface layer thereof was white, opaque, porous and had cushioning characteristics. The surface thickness was 20 μm, the whiteness degree was 68% and the opaqueness was 74%.

The obtained OHP sheet was printed in full colors by means of a thermal transfer printer and dried for two minutes in a constant-temperature drier of 120° C. Consequently, the surface layer was made transparent and an OHP sheet in which the capacity of the representation of dots in detailed portion and tone gradation was excellent, could be obtained.

EXAMPLE 4

400 parts of styrene polymer particles used in Example 3 was mixed with vinyl chloride-vinyl acetate copolymer emulsion and the mixture was agitated completely to obtain coating solution.

This solution was coated and dried under the same coating condition as in Example 1 to obtain a further type of OHP sheet of the present invention. The surface layer thereof was white, opaque, porous and had cushioning characteristics. The surface thickness was 23 μm, the whiteness degree was 78% and the opaqueness was 84%.

The obtained OHP sheet was printed in full colors by means of a thermal transfer printer and dried for two minutes in a constant-temperature drier of 120° C. Consequently, the surface layer was made transparent and an OHP sheet in which the capacity of the representation of dots in detailed portion and tone gradation was excellent, could be obtained.

What is claimed is:

1. An OHP sheet for a thermal transfer printer which is a transparent plastic sheet having an ink receiving layer on at least one side thereof, the ink receiving layer being a porous layer which contains polymer particles in which the glass transition temperature is 30°–150° C. and the particle size is 0.05–2 μm, further the ink receiving layer being opaque under normal temperatures and then becoming transparent when the layer is heated to 30°–150° C.

2. An OHP sheet according to claim 1, wherein said ink receiving layer contains polymer particles in a binder.

3. An OHP sheet according to claim 2, wherein said binder is one or more selected from the group consisting of vinyl chloride-acetate copolymer resin, polyester resin and acrylic resin.

4. An OHP sheet according to claim 2, wherein 100–500 parts by weight of the polymer particles are used per 100 parts by weight of the binder.

5. An OHP sheet according to claim 2, wherein said polymer particles are selected from the group consisting of styrene polymer, styrene-butadiene copolymer and styrene-acrylic copolymer.

6. An OHP sheet according to claim 1, wherein said polymer particles are selected from the group consisting of styrene polymer, styrene-butadiene copolymer and styrene-acrylic copolymer.

* * * * *